US008905087B2

(12) United States Patent
Airaksinen

(10) Patent No.: US 8,905,087 B2
(45) Date of Patent: Dec. 9, 2014

(54) PAINT MIXING MACHINE

(75) Inventor: Pentii Airaksinen, Oulu (FI)

(73) Assignee: Xemec Oy, Oulu (FI)

( * ) Notice: Subject to any disclaimer, the term of this patent is extended or adjusted under 35 U.S.C. 154(b) by 367 days.

(21) Appl. No.: 13/510,654

(22) PCT Filed: Nov. 19, 2010

(86) PCT No.: PCT/FI2010/050939

§ 371 (c)(1),
(2), (4) Date: Jul. 30, 2012

(87) PCT Pub. No.: WO2011/061406

PCT Pub. Date: May 26, 2011

(65) Prior Publication Data

US 2012/0285582 A1 Nov. 15, 2012

(30) Foreign Application Priority Data

Nov. 20, 2009 (FI) ..... 20096209

(51) Int. Cl.

| | |
|---|---|
| ***B01F 13/00*** | (2006.01) |
| ***B65B 3/04*** | (2006.01) |
| ***B01F 13/10*** | (2006.01) |
| ***B44D 3/08*** | (2006.01) |

(52) U.S. Cl.

CPC ..... *B01F 13/1055* (2013.01); *B65B 3/04* (2013.01); *B01F 2215/005* (2013.01); *B44D 3/08* (2013.01)

USPC ..... 141/103; 141/104; 141/231; 141/373; 700/265

(58) Field of Classification Search

CPC ..... B65B 3/04; B44D 3/08; B01F 13/1055; B01F 2215/005

USPC ..... 141/94, 103, 104, 231, 234, 369–371, 141/373, 392; 700/245, 265

See application file for complete search history.

(56) References Cited

U.S. PATENT DOCUMENTS

| | | | | |
|---|---|---|---|---|
| 3,785,412 | A | 1/1974 | Stone | |
| 4,323,097 | A | 4/1982 | Achen | |
| 4,967,938 | A * | 11/1990 | Hellenberg | 222/144 |
| 5,083,591 | A * | 1/1992 | Edwards et al. | 141/9 |
| 5,381,837 | A * | 1/1995 | Kurosu et al. | 141/103 |
| 5,493,840 | A * | 2/1996 | Cane | 53/50 |
| 5,938,080 | A * | 8/1999 | Haaser et al. | 222/144 |
| 6,585,012 | B1 * | 7/2003 | Iovino | 141/104 |
| 6,793,387 | B1 * | 9/2004 | Neas et al. | 366/160.4 |

(Continued)

FOREIGN PATENT DOCUMENTS

| | | |
|---|---|---|
| EP | 0537434 | 4/1993 |
| ES | 2169957 | 7/2002 |

*Primary Examiner* — Nicolas A Arnett

(74) *Attorney, Agent, or Firm* — Otterstedt, Ellenbogen & Kammer, LLP

(57) ABSTRACT

The invention relates to a paint mixing machine comprising a body (1), a plurality of containers (3) fixed with respect to the body and containing a pigment paste to be dosed into a paint pot (2), for each container, dosing equipment fixed with respect to the body for dosing paste contained in each container into the paint pot via nozzles (4) of the dosing equipment, and means for using the dosing equipment, wherein a robot (6) is arranged beneath the dosing nozzles (4) for moving the paint pot (2) along the robot's freely selected paths in a space coordinates system at least in relation to a currently selected dosing nozzle (4).

12 Claims, 4 Drawing Sheets

(56) References Cited

U.S. PATENT DOCUMENTS

| | | | | |
|---|---|---|---|---|
| 6,926,171 | B2 * | 8/2005 | Reedy et al. | 222/108 |
| 6,991,004 | B2 * | 1/2006 | Kaufhold et al. | 141/83 |
| 7,147,012 | B2 * | 12/2006 | Kaufhold et al. | 141/11 |
| 7,343,941 | B2 * | 3/2008 | Heatley et al. | 141/9 |
| 7,919,546 | B2 * | 4/2011 | Trevino et al. | 523/318 |
| 7,951,855 | B2 * | 5/2011 | Trevino et al. | 523/318 |
| 8,014,885 | B2 * | 9/2011 | Hughes et al. | 700/97 |
| 8,752,594 | B2 * | 6/2014 | Gebhard et al. | 141/11 |
| 2009/0099694 | A1 * | 4/2009 | Trevino et al. | 700/265 |
| 2010/0198392 | A1 * | 8/2010 | Eliuk et al. | 700/216 |
| 2012/0216911 | A1 * | 8/2012 | Bartholomew et al. | 141/9 |

* cited by examiner

PAINT MIXING MACHINE

The present application is a national stage entry, under 35 USC 371, of PCT International Patent Application Number PCT/FI2010/050939 filed on 19 Nov. 2010, which claims priority to Finnish Patent Application Number 20096209 filed on 20 Nov. 2009. The complete disclosures of the aforesaid International Patent Application Number PCT/FI2010/050939 and Finnish Patent Application Number 20096209 are expressly incorporated herein by reference in their entireties for all purposes.

BACKGROUND OF THE INVENTION

The invention relates to a paint mixing machine comprising at least a body, a plurality of containers fixed with respect to the body and containing a pigment paste to be dosed into a paint pot, for each container, dosing equipment fixed with respect to the body for dosing paste contained in each container into the paint pot via nozzles of the dosing equipment, and means for using the dosing equipment.

Various mixing machines exist wherein the arrangement of pumps of dosing equipment controlling valves of containers and the dosing equipment affects the structure of the machine.

Machines are known that are provided with containers rotating on the circumference thereof and piston pumps connected to one another, wherein one paste at a time is selected to be dosed. An actuator driving the dosing equipment is a fixed, stationary mechanism which grips both a piston rod in the pump and a valve. These arrangements are known as manual versions and as various automatic machines.

Machines also exist wherein pumps and containers are fixedly stationary, in which case for each paste a gear pump or a membrane pump is provided and in which case the drive of a given pump may be arranged e.g. by a solenoid.

A manually operated mixing machine from the 1970's is also known wherein a pot is moved manually along an extensive bar until beneath a dosing pump wherefrom a paste is dosed into a pot one at a time.

Furthermore, an automatic machine exists wherein dosing takes place from fixed pumps mounted in a curved arrangement into a pot with an aperture such that one paste at a time enters the pot. A rotatable pot tray fixedly connected to a dosing mechanism moves the aperture in the pot synchronically under the dosing pump.

The aforementioned machines suffer from serious drawbacks. These are usually caused by the structure of either the pumps or the containers. If a structure is used which has a plurality of containers that move simultaneously when pastes are being selected, severe mechanical problems arise since in the worst case, the moving masses may weigh several hundreds of kilograms. Consequently, the most advantageous solution to date has been one wherein the pump of the dosing equipment is a piston pump and the container structure is a fixed one.

Even if on account of fixed containers and dosing equipment as well as the simplicity of the dosing equipment it has thus been possible to make the operation of mixing machines functional in terms of these issues, the actual procedure of moving the paint pot while bringing it to the mixing machine, moving it therein underneath the dosing nozzles and while removing it from the mixing machine has been ignored completely. The known solutions are fixed structures strictly confined to a particular mixing machine structure, only and exclusively suitable for moving the paint pot when it is located underneath the dosing nozzles.

SUMMARY OF THE INVENTION

An object of the invention is thus to provide a completely novel paint mixing machine so as to eliminate the aforementioned limitations of moving a paint pot. This object is achieved by a paint mixing machine according to the invention, which is mainly characterized in that a robot is arranged beneath the dosing nozzles for moving the paint pot along the robot's freely selected paths in a space coordinates system at least in relation to a currently selected dosing nozzle, the robot comprising at least a vertical conveyor and a horizontal conveyor.

Preferred embodiments of the invention are disclosed in the dependent claims.

Now, according to the invention, a paint pot is transferred from an external conveyor to a paint mixing process by means of a robot. Typically, such a robot has movements according to an x-y-z coordinate system to enable the pot to be brought to a desired horizontal position and to a desired height. When the paint mixing machine is provided with several dozens of mixing points, the robot, readily programmed, may quickly move from one position to another and move the pot exactly to a point at which a given process takes place.

The robot according to the invention also makes it possible to move the paint pot by a single programmable entity of movements to procedures of puncturing a lid of the paint pot, actual mixing, sealing the lid, to an agitator mixing the contents of the paint pot and, therefrom, to an exterior conveyor.

In order to serve the entire mixing process, the mixing machine according to the invention is provided with a special robot fixedly mounted in the mixing machine. This enables the entire process to be automated such that a pot of any size or shape may be positioned automatically under the dozing nozzles from any direction. With no additional costs, the robot enables the lid of the pot to be processed such that the paste becomes admixed with the paint and the lid remains leak-proof during all phases of the process. This may be carried out e.g. by puncturing and sealing the lid by employing the programmable paths of the robot.

Preferably, the mixing machine may comprise as an integral part thereof a detection member which, during puncturing and sealing of the lid of the paint pot, is in contact therewith and which, by an accurate vertical movement of the robot, enables bendings in the lid caused by forces directed to the lid to be controlled and such bendings to be fixed by a sensor connected to the detection member. This enables the lid to be provided with an aperture in a reliable manner, since all known lid puncturing methods are critical in terms of lid bendings. The same applies to reliable sealing.

A single robot may serve for supplying and removing the paint pot automatically to/from the agitators and external conveyors. Preferably, this takes place such that the conveyor entity of the robot connects to the external conveyors and at the same time constitutes a conveyor surface which continues on the same plane, by using suitable connecting means, for instance friction or gear contact connected to both conveyors. In such a case, no actuators are necessary in the external conveyors but the movement of the conveyor of the robot makes the external conveyors move. Simultaneously, the movements of the interconnected conveyors become synchronized by themselves, making the movement of the paint pot continuous also when the paint pot or the tray thereof moves from one conveyor to another. A robot actuator according to the invention may thus replace 3 to 5 actuators otherwise necessary for the conveyors in connection with the mixing machine.

Combining the robot and the mixing machine in this manner into a compact, simple, and reliable as well as inexpensive entity makes it possible to automate process functions for which no industrial robots nor industrial automation widely known to those skilled in the art have been profitable.

LIST OF FIGURES

The invention is now described in closer detail with reference to the accompanying simplified and diagrammatic drawings, in which FIG. 1 is a perspective view of a paint mixing machine according to the invention, as seen obliquely from below;

DETAILED DESCRIPTION OF THE INVENTION

Figure 1:
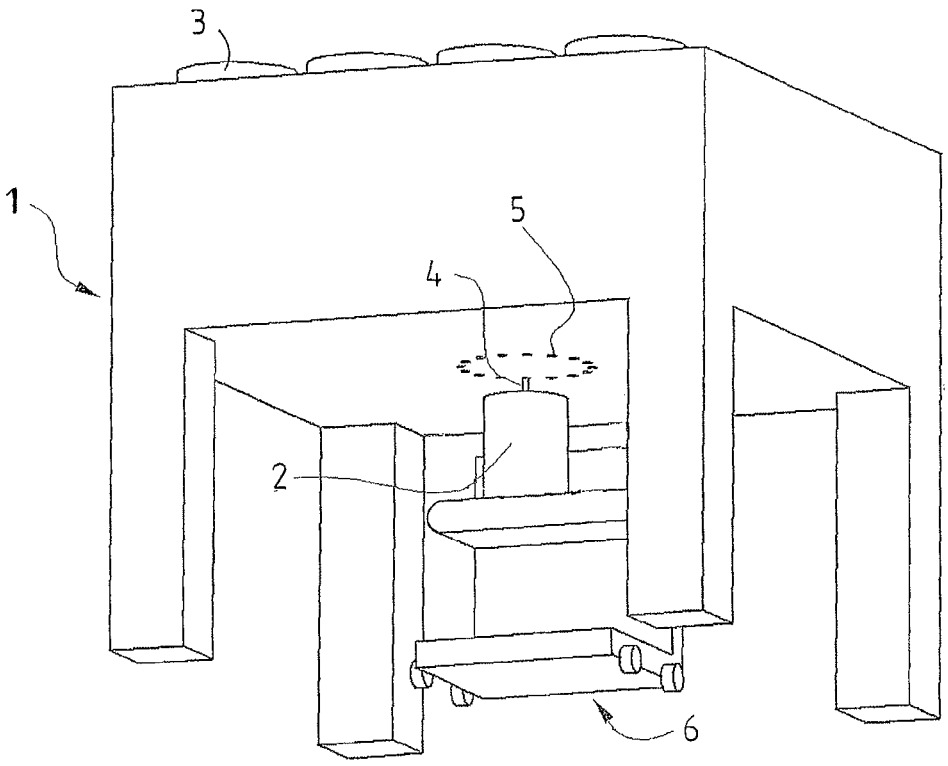
Figure 2:
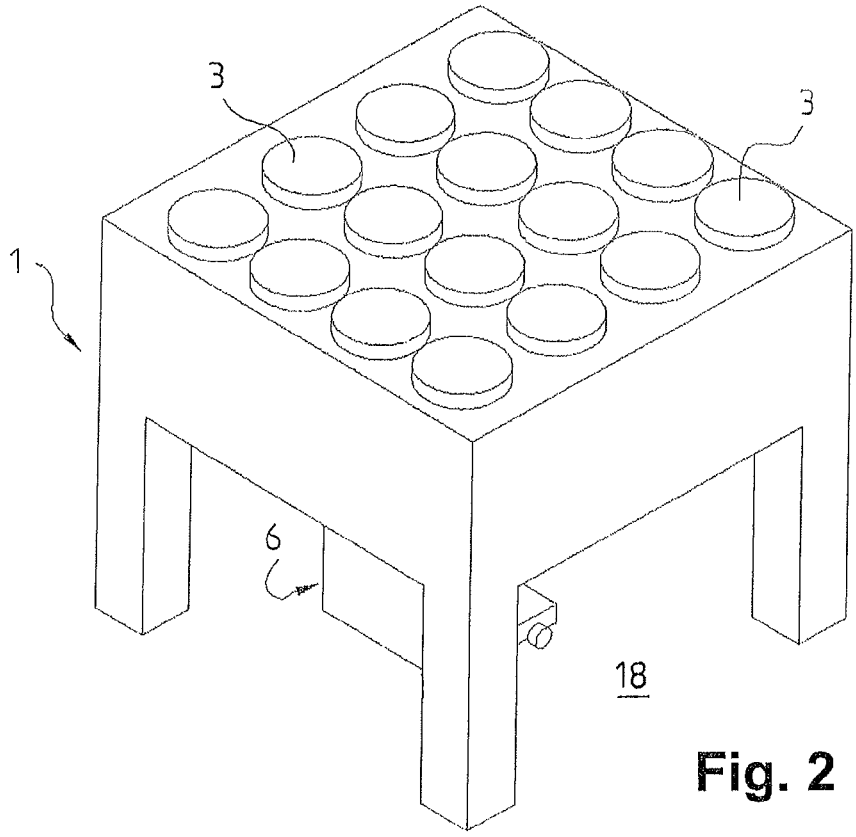
FIG. 2 is a perspective view of the paint mixing machine according to FIG. 1, as seen obliquely from above.
Figure 3:
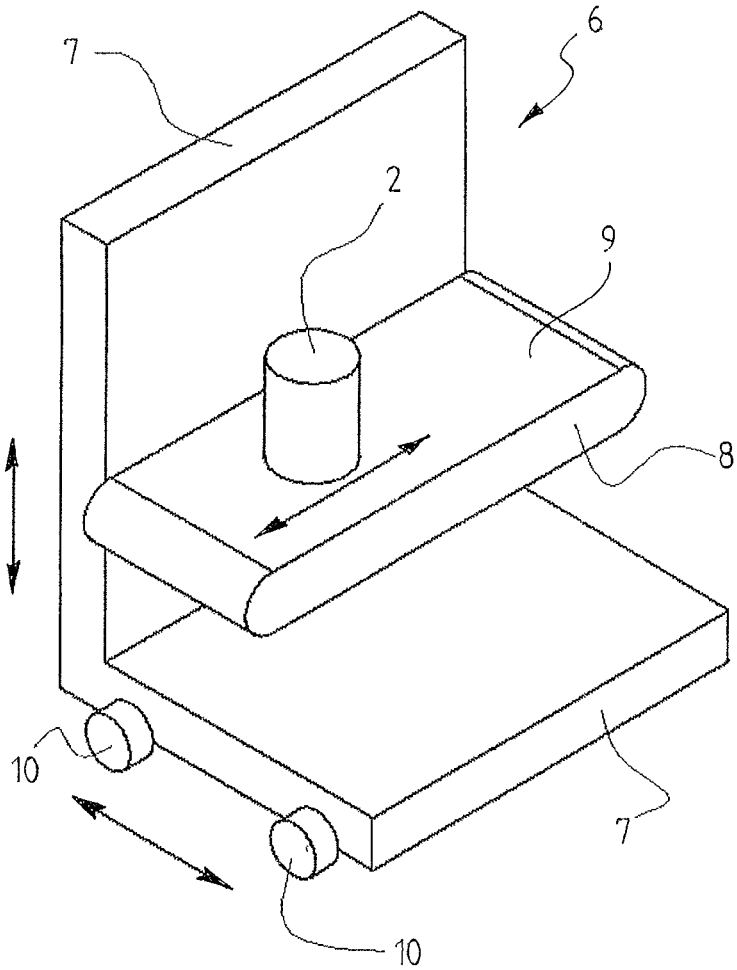
FIG. 3 is a separate perspective view of the robot shown in the previous figures.

The paint mixing machine shown in the figures comprises a body 1, a plurality of containers 3 fixed with respect to the body 1 and located at an upper part thereof and containing a pigment paste to be dosed into a paint pot 2, for each container 3, dosing equipment fixed with respect to the body 1 for dosing paste contained in each container 3 into the paint pot 2 via nozzles 4 of the dosing equipment, and means for using the dosing equipment. Herein, the dosing nozzles 4 are preferably arranged fixedly in the shape of a circle 5. Naturally, the nozzles 4 may be installed in any shape or order, e.g. fixedly rectilinearly, since a robot 6, which will be described below, within the scope of its coordinate systems, is able to position the pot 2 anywhere underneath the machine. As actuators of the dosing equipment itself, it is appropriate to use a single common mechanism. However, representing the prior art known per se, no dosing equipment nor the actuators thereof are separately shown herein.

Instead, an essential point in the invention is that a robot 6 is arranged beneath the dosing nozzles 4 for moving the paint pot 2 in a sideways direction until it resides at a dosing nozzle 4 selected at a given time and for lifting and lowering the paint pot 2 with respect to the dosing nozzle 4.

The robot 6 comprises a body 7, a vertical conveyor 8 arranged in the body and moving in a vertical direction, a horizontal conveyor 9 arranged in the vertical conveyor 8 and moving in a horizontal direction, and wheels 10 arranged in a lower part of the body 7 to enable the robot 6 to move.

The movement of the vertical conveyor 8 may preferably be implemented by a chain so as to enable a reliable and strong structure to be achieved. This also enables a lightweight structure to be implemented since no motors are then needed in the vertical conveyor 8.

Figure 4:
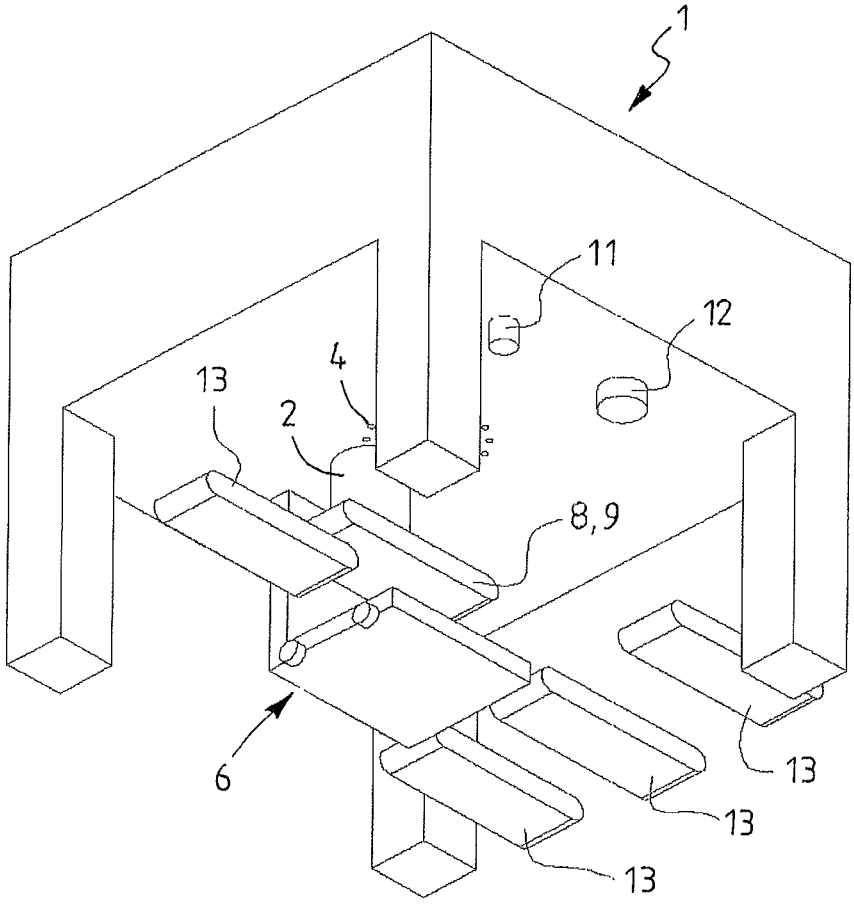
FIG. 4 is a perspective view of a paint mixing machine with additional functions, as seen obliquely from below and the paint mixing machine according to FIG. 1 taken as a starting point.

According to the embodiment shown in FIG. 4, the robot 6 is also configured to move to positions separate from the dozing nozzles 4, whereby the robot 6 is able to move, in a freely programmed manner, between the paint mixing device and a puncturing device 11 for a lid of the paint pot, a sealing device for the lid of the paint pot, an agitator (not shown), and external conveyors 13 relating to the paint mixing machine or constituting an entity therewith. Since a person skilled in the art may implement the devices 11 and 12 in many different ways, they are shown only schematically herein.

Figure 5:
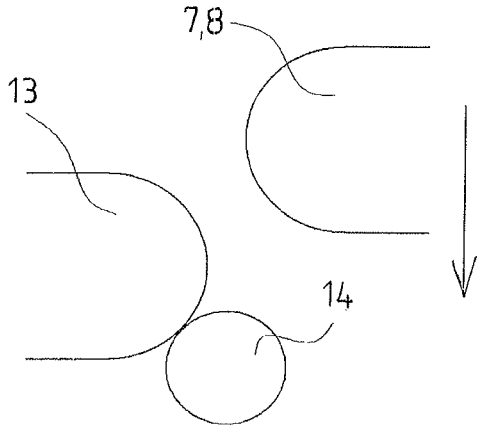
FIGS. 5 and 6 show movement of a paint pot from an external conveyor to a robot.
Figure 6:
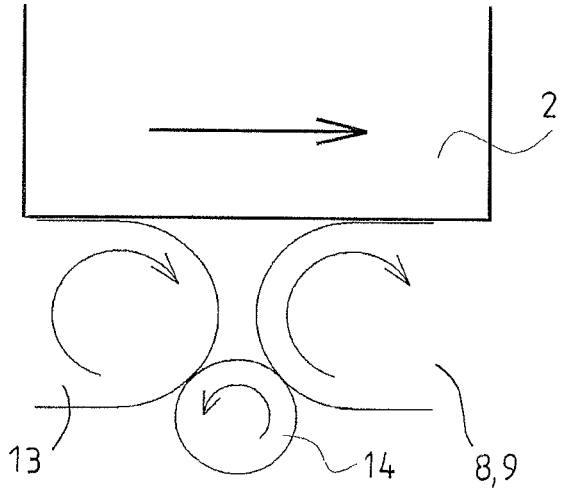

It can be seen in FIGS. 5 and 6 how the robot 6, utilizing its movements and by means of the vertical movements of the vertical conveyor 8 of its conveyor entity 8, 9, may eventually connect to the external conveyors 13 that are used for moving the paint pot 2 between the paint mixing machine and the external processes. The conveyor entity 8, 9 of the robot 6 and the external conveyor 13 may become interconnected only when their ends that are meant to reside towards one another meet both in the vertical and horizontal directions. In such an interconnected state, by means of an intermediate wheel 14 provided in the external conveyor 13 (or, alternatively, in the robot 6), the movement of the external conveyor 13 and the horizontal conveyor 9 of the robot may be synchronized when the intermediate wheel 14 connects to both conveyors 13 and 9 as shown in FIG. 6. The external conveyors 13 may be implemented by belts, chains, roller assemblies, wheels or in any known manner. The connection of the intermediate wheel 14 to the external conveyor 13 and to the conveyor entity of the robot 6, again, may be implemented in a friction-driven manner by gears, switches or in other known manners. If the intermediate wheel 14 derives its driving force from the conveyor entity 8, 9 of the robot 6, no actuators are then needed in the external conveyors at all since the intermediate wheel 14 makes them move. When the conveyor entity 8, 9 and the external conveyor 13 meet and the intermediate wheel 14 has been connected to operate therebetween, the paint pot 2 (including its possible tray) moves from one conveyor to another as shown in FIG. 6.

Figure 7:
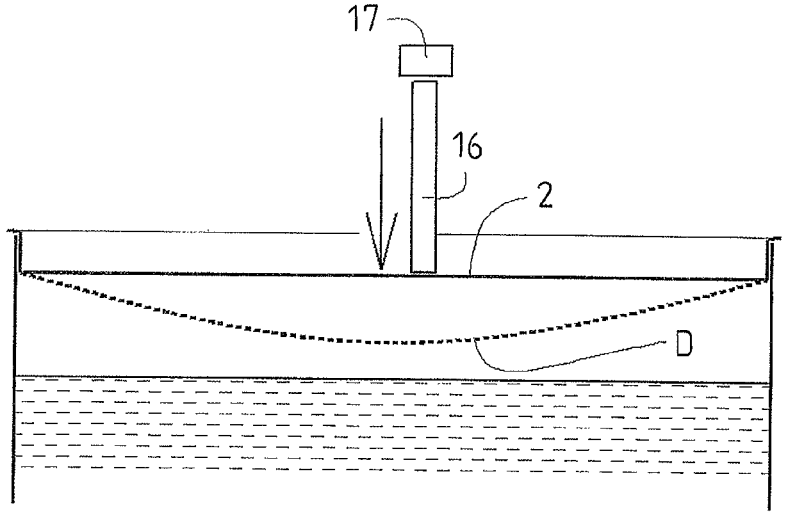
FIG. 7 shows puncturing and sealing of a lid for a paint pot in connection with the robot according to the invention.

According to FIG. 7, the mixing machine includes as an integral part thereof a detection member 16 which, during puncturing and sealing of the lid 15 of the paint pot 2, is in contact therewith and which is provided in both the puncturing device 11 and the sealing device 12, enabling distance errors of a bending D in the lid 15 that are caused by forces directed to the lid 15 to be controlled by the detection member 16 by utilizing an accurate vertical movement of the conveyor entity 8, 9 of the robot 6 and such distance errors to be fixed by a sensor 17 connected to the detection member 16.

In order to make it easier for the robot 6 to move around, it is provided with a free movement space 18 beneath the paint mixing machine.

When suitable detectors and sensors are used for controlling the movement of the robot 6, its movements may be ensured with no collisions or erratic movements.

The above-disclosed description of the invention is only meant to illustrate the basic idea according to the invention. Thus, a person skilled in the art may implement the details of the invention in many different ways within the scope of the attached claims.

The invention claimed is:

1. A paint mixing machine comprising:

a body;

a plurality of containers fixed with respect to the body and containing a pigment paste to be dosed into a paint pot;

for each container, dosing equipment fixed with respect to the body for dosing paste contained in each container into the paint pot via nozzles of the dosing equipment;

and a robot arranged beneath the dosing nozzles for moving the paint pot along freely selected paths of the robot in a space coordinates system at least in relation to a currently selected dosing nozzle, the robot comprising at least a vertical conveyor and a horizontal conveyor.

2. A machine as claimed in claim 1, wherein the dosing nozzles are arranged fixedly in a circular shape.

3. The machine as claimed in claim 2, wherein the means for using the dosing equipment are formed by a single mechanism whose movement is adapted to conform with the shape formed by the dosing nozzles.

4. A machine as claimed in claim 1, wherein the dosing nozzles are arranged fixedly in a rectilinear manner.

5. The machine as claimed in claim 4, wherein the means for using the dosing equipment are formed by a single mechanism whose movement is adapted to conform with the shape formed by the dosing nozzles.

6. A machine as claimed in claim 1, wherein the robot is also configured to move to positions that are separate from the dosing nozzles.

7. A machine as claimed in claim 6, wherein the robot is configured to move, in a freely programmed manner, between the paint mixing device and a puncturing device, a sealing device for the lid of the paint pot, an agitator, and at least one external conveyor relating to the paint mixing machine or constituting an entity therewith.

8. A machine as claimed in claim 7, wherein:

the vertical conveyor is arranged to move vertically in a body of the robot, the horizontal conveyor is arranged to move horizontally in the vertical conveyor, and a lower part of the body is provided with wheels.

9. A machine as claimed in claim 8, wherein, in order to interconnect the external conveyor and the vertical conveyor and horizontal conveyor of the robot, the external conveyor or the robot is provided with an intermediate wheel for driving the external conveyor by an actuator of the vertical conveyor and horizontal conveyor of the robot.

10. A machine as claimed in claim 7, wherein the puncturing device and the sealing device comprise a detection member which at a given time comes into contact with the lid of the paint pot for detecting bending in the lid, and a sensor connected to the detection member.

11. A machine as claimed in claim 1, wherein the robot is provided with a free movement space beneath the paint mixing machine.

12. A machine as claimed in claim 1, wherein:

the vertical conveyor is arranged to move vertically in a body of the robot, the horizontal conveyor is arranged to move horizontally in the vertical conveyor, and a lower part of the body is provided with wheels.

* * * * *